US011590054B2

(12) United States Patent
Dopfer et al.

(10) Patent No.: US 11,590,054 B2
(45) Date of Patent: Feb. 28, 2023

(54) APPLIANCE FOR CARDIOPULMONARY MASSAGE AND/OR RESUSCITATION

(71) Applicant: GS ELEKTROMEDIZINISCHE GERÄTE G. STEMPLE GMBH, Kaufering (DE)

(72) Inventors: Sarah Dopfer, Augsburg (DE); Michael Heller, Landsberg (DE); Christian Klimmer, Kaufering (DE)

(73) Assignee: GS Elektromedizinische Gerate G. Stemple GmbH, Kaufering (DE)

( * ) Notice: Subject to any disclaimer, the term of this patent is extended or adjusted under 35 U.S.C. 154(b) by 482 days.

(21) Appl. No.: 16/628,211

(22) PCT Filed: Jun. 25, 2018

(86) PCT No.: PCT/IB2018/054654
§ 371 (c)(1),
(2) Date: Jan. 2, 2020

(87) PCT Pub. No.: WO2019/012355
PCT Pub. Date: Jan. 7, 2019

(65) Prior Publication Data

US 2021/0145693 A1 May 20, 2021

(30) Foreign Application Priority Data

Jul. 13, 2017 (DE) ..... 10 2017 115 732.8

(51) Int. Cl.
*A61H 31/00* (2006.01)

(52) U.S. Cl.
CPC ..... *A61H 31/006* (2013.01); *A61H 2201/018* (2013.01); *A61H 2201/0176* (2013.01);
(Continued)

(58) Field of Classification Search
CPC ..... A61H 31/006; A61H 2201/0176; A61H 2201/018; A61H 2201/0192; A61H 2201/1664
See application file for complete search history.

(56) References Cited

U.S. PATENT DOCUMENTS 3,219,031 A * 11/1965 Samuelb ..... A61H 31/007 601/41
3,512,522 A 5/1970 Greenlee et al.
(Continued)

FOREIGN PATENT DOCUMENTS

CN 201806912 U 4/2011
CN 203747967 U 7/2014
(Continued)

OTHER PUBLICATIONS

International Search Report dated Oct. 4, 2018 for International Application No. PCT/IB2018/054654.

*Primary Examiner* — Samchuan C Yao
*Assistant Examiner* — Minhua Zhao
(74) *Attorney, Agent, or Firm* — Fay Sharpe LLP

(57) ABSTRACT

The device according to the invention is used for a cardiopulmonary massaging and/or resuscitation of a patient and is provided with a massage stamp (17) which can be reversibly driven by a drive device in an actuation direction (18) and which has a pressure surface (31) that can be positioned at a contact region on the chest (12) of a patient (11). In order to ensure that the chest compressions are interrupted upon reaching a specified compression force, the massage stamp (17) has a stamp upper part (19) and a stamp lower part (20) which is operatively connected to the stamp upper part (19). The stamp upper part (19) and the stamp lower part (20) can be adjusted relative to each other in the actuation direction (18) at least between a first position which defines a working length (L) and a second position in which an effective length
(Continued)

Figure 1:
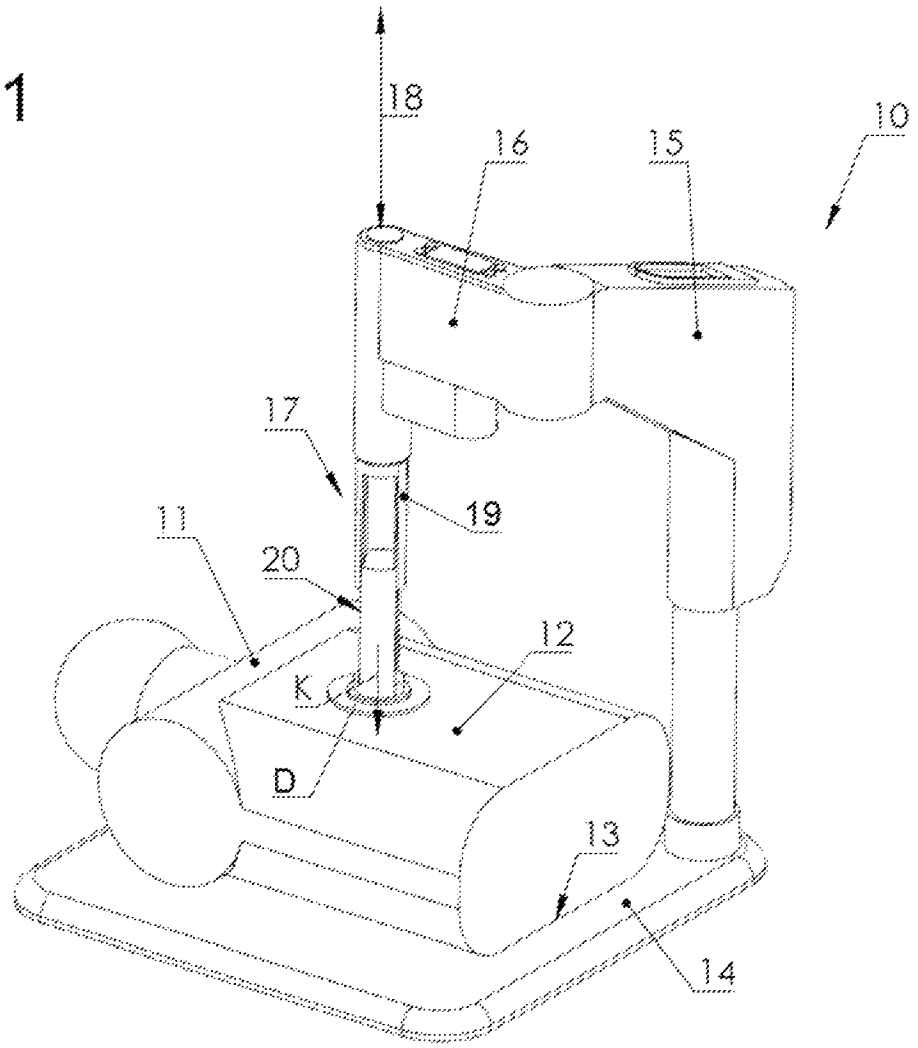

(1) of the massage stamp (17) is shortened compared to the working length (L). In the first position, the stamp upper part (19) is locked with the stamp lower part (20) by means of a releasable locking mechanism (21) and the locking mechanism (21) is released upon reaching or exceeding a specified compression force transmitted by the massage stamp (17).

15 Claims, 5 Drawing Sheets

(52) U.S. Cl.
CPC ..... *A61H 2201/0192* (2013.01); *A61H 2201/1664* (2013.01)

(56) References Cited

U.S. PATENT DOCUMENTS 3,552,390 A 1/1971 Muller
5,484,391 A 1/1996 Buckman, Jr. et al.
6,648,841 B1 * 11/2003 Sessler ..... A61M 16/0075 601/41
2008/0287863 A1 11/2008 Bisera et al.
2010/0185127 A1 * 7/2010 Nilsson ..... A61H 31/00 601/41
2011/0104650 A1 5/2011 May et al.
2011/0165546 A1 7/2011 May et al.
2011/0201979 A1 8/2011 Voss et al.
2014/0088467 A1 * 3/2014 Parascandola ..... A61H 31/006 601/41
2014/0155792 A1 6/2014 Karve et al.
2015/0119768 A1 * 4/2015 Meier ..... A61H 31/008 601/41
2015/0352002 A1 12/2015 Jeppsson et al.
2015/0366751 A1 12/2015 Stemple

FOREIGN PATENT DOCUMENTS

DE 10 2013 100 943 A1 7/2014
EP 1 857 342 A1 11/2007
JP 2002272801 A 9/2002
JP 2015533552 A 11/2015
WO WO 04/03142 2/1994
WO WO-9403142 A1 * 2/1994 ..... A61M 1/1068
WO WO 2015/061677 A1 4/2015

* cited by examiner

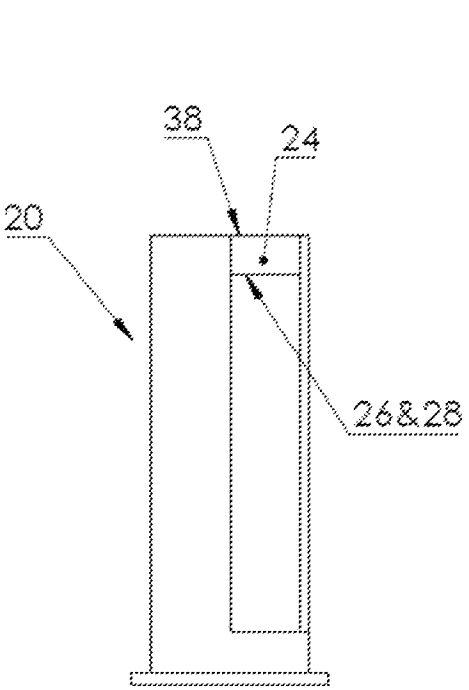
Fig.5c
Fig.5b
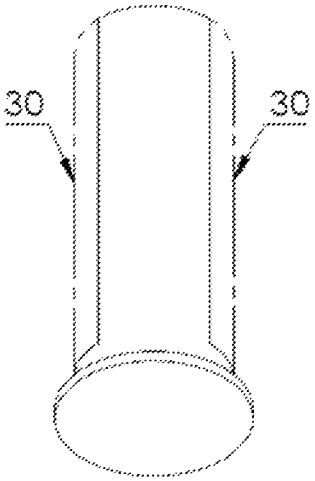
Fig.5a

APPLIANCE FOR CARDIOPULMONARY MASSAGE AND/OR RESUSCITATION

The invention relates to a device for cardiopulmonary massage and/or resuscitation, with a massage stamp which can be reversibly driven by a drive apparatus in an actuation direction, which massage stamp has a pressure surface which can be positioned on a contact region at the thorax of a patient.

Cardiovascular arrest means greatest danger to life for a patient. Only if an "emergency circulation" is successfully established and maintained within a very short time by means of cardiopulmonary resuscitation, there is any real chance that the patient will survive without permanent damage. Apart from respiration, a central part of cardiopulmonary resuscitation is the performance of a cardiac massage to produce a substitute circulation of blood, so that vital organs, such as in particular the brain, are supplied with oxygen. The classic cardiac massage is thereby performed manually, i.e. for example by a paramedic, who compresses and releases the thorax of the patient in the region of the sternum with frequencies of the order of 80-140 per minute and hereby causes blood to circulate through the body of the patient and thereby effects oxygen supply to the organs.

Manual compression of the thorax for resuscitation is very strenuous for the helper carrying it out and can be performed only for a limited time at the frequency required. Because it frequently has to be continued also during transfer of the patient to hospital, mechanical devices for cardiopulmonary massage have been suggested, which complement the technical equipment of emergency vehicles, helicopters or the like and with the help of which the cardiac massage on patients can be carried out mechanically over practically any length of time, without the life-savers becoming tired. Instead, they can initiate complementary life-saving measures while the mechanical device performs the thorax compression to maintain the emergency cycle. For this purpose, such a device has a massage stamp which is movable by a drive and is moved up and down at the desired frequency, thus approximately 80-140 times per minute. Thereby, the pressure surface arranged at the bottom of the massage stamp transmits the force required for carrying out the cardiac pressure massage to the contact region on the thorax of the patient and compresses it to the desired depth.

It is not only important in the execution of the cardiac massage that the correct pressure point, namely directly above the sternum of the patient, is used and also maintained during the massage, as described in detail in the generic DE 10 2013 100 943 A1. It is also endeavored to avoid injury to the patient due to the thorax compression, which may be the result of too great a compression force or depth in the case of cardiac massage. Even if, for example, rib fractures cannot be avoided with certainty due to a lack of thorax strength of the patient, such injuries should as far as possible not occur due to errors in the cardiac pressure massage, thus too great a compression force applied or the wrong starting point of the compression. The risk of injury as a result of too high pressure force is relatively high in the case of (small) children and adolescents.

The object of the invention is to improve a device of the generic type such that injuries to the patient as a result of excessive compression force during cardiac massage of the thorax can be reliably avoided. This object is solved with the invention by the combination of the features of the independent patent claim 1.

According to the invention, with the two-part arrangement of the massage stamp consisting of a stamp upper part and a stamp lower part, and the locking mechanism provided between these two stamp parts, an automatic termination/interruption of the massage process is ensured upon reaching/exceeding the predetermined maximum allowable compression force in the treatment of the respective patient. The locking mechanism releases upon reaching/exceeding the predetermined compression force and cancels the lock, resulting in an at least substantially force-free adjustment of the stamp lower part relative to the stamp upper part in a shortened length relative to the working length. The two stamp parts are thus adjusted relative to one another, for example inserted into each other, so that the then effective (shortened) length of the massage stamp is significantly less compared to the working length, so that even if the drive apparatus continues to run and an up and down movement of the massage stamp accompanying this, it either no longer touches the thorax of the patient with the pressure surfaces or at least only executes a clearly smaller compression path and thereby also transmits a lower compression force than is the case with the full working length of the massage stamp. In this way it is ensured that there are no injuries, for example rib fractures of the treated patient due to excessive compression forces.

In a particularly preferred design of the invention, the locking mechanism is essentially formed by a magnetic holding device effective between the stamp upper part and the stamp lower part, whose magnetic holding force corresponds to the predetermined compression force. If the predetermined maximum permitted compression force is achieved in the direction of movement of the massage stamp, the magnetic holding force of the magnetic holding device is overcome, so that the magnetic holding device forming the locking mechanism directly opens and the previously existing force-fit connection between the stamp upper part and the stamp lower part is cancelled. The stamp lower part then no longer carries out the movement of the stamp upper part, which is coupled to the drive apparatus and is moved up and down therewith, but is rather displaced relative to the stamp upper part in the sense of shortening the effective length of the massage stamp.

On the other hand, it is also possible that the locking mechanism is essentially formed by a ring or hook-snap connection effective between the stamp upper part and the stamp lower part, which is released when reaching the predetermined allowable compression force and releases the connection between the stamp upper part and lower part.

It has proven to be advantageous if the stamp upper part and the stamp lower part are aligned coaxially with one another and are guided telescopically into one another. This arrangement is particularly space-saving. Furthermore, it is particularly suitable for transmitting the compression force acting essentially only in the Z-direction (vertical direction). The Z-direction is defined as the direction in which the cardiac massage is performed, that is, the direction in which the stamp is moved up and down to compress the thorax of the (normally supine) patient in the downward movement and relieve it again in the opposite upward movement.

The stamp upper part can have an upper part bottom and the stamp lower part a bottom part cover, which is located in the massage stamp above the upper part bottom, wherein the locking mechanism engages between the upper part bottom and the bottom part cover and/or is formed by these. This design has proven itself in particular when using a magnetic holding device as locking mechanism. It is then provided in a particularly preferred manner that the locking mechanism comprises at least one holding magnet arranged on the upper part bottom and/or on the lower part cover or is formed thereby, which then cooperates with a ferromagnetic surface on the respective opposite part and/or a magnetic pole provided there having opposite polarity.

If the magnetic holding device has at least one exchangeable holding magnet, it is particularly easy to change the compression force which can be transmitted by the magnetic holding device, namely by simply exchanging the respective holding magnet with another one having a lower or higher holding force. It is also possible to change the holding force of a magnetic holding device effective between the stamp upper part and the stamp lower part in that the distance between the two magnetic poles attracting each other or a magnet and a ferromagnetic counterpart cooperating therewith can be changed.

In constructional terms, a design of the invention has proved to be successful, in which the stamp upper part and the stamp lower part are provided with complementary recesses for the passage of the upper part bottom in the stamp lower part and the lower part cover part arranged in their circumferential walls, extending over substantially their entire height. The recesses and the longitudinal webs on the stamp lower and upper part then engage with each other in a claw-like manner, whereby a stable, non-rotating arrangement of the two stamp parts is achieved, which, when releasing the locking mechanism and pushing together of the stamp parts then taking place in the longitudinal direction of the massage, are guided in a form-fit manner. In this embodiment, it is preferably provided that the stamp upper part and the stamp lower part each have at least two recesses (and a quantity of longitudinal webs adapted in number and dimensions).

In order to be able to quickly and easily couple the massage stamp with the drive apparatus and, if necessary, to exchange it for another stamp with other dimensions, in an advantageous further development of the invention, a connection adapter arranged at the upper end of the stamp upper part is provided for quick connection to the drive apparatus. Furthermore it is advantageous if the pressure surface at the lower end of the stamp lower part is arranged in an exchangeable manner, it can then be exchanged with an element with smaller or larger, more effective compression surface and/or with another geometric design, for example, round, elliptical, spherical etc.

It is also particularly advantageous with the invention, if a securing mechanism preferably effective between the stamp upper part and the stamp lower part is provided, which after a release of the locking mechanism and adjustment of the stamp lower part relative to the stamp upper part, holds their position to each other in the second position. Such a securing mechanism can advantageously essentially be formed by a securing holding magnet preferably effective between the upper side of the lower part cover and a counter surface formed on the upper end of the stamp upper part or on the counter surface formed on the drive apparatus and/or a preferably spring-loaded snap-hook connection. The securing mechanism ensures that after a single release of the holding mechanism and the subsequent displacement of the stamp lower part relative to the stamp upper part into the second (shortened) position, the massage stamp cannot give up this shortened length by itself, as the securing mechanism holds the stamp lower part in the second position until the user of the device releases the connection again consciously, for example, after the parameters for performing the cardiac massage have been newly set on the relevant patient in order to prevent a renewed release of the locking mechanism. It is also possible to ensure with the aid of a spring or another suitable actuator that, after releasing the locking mechanism, the stamp lower part is actively retracted until it reaches the second position and is then locked in this by means of the securing mechanism.

Figures 2A, 2B:
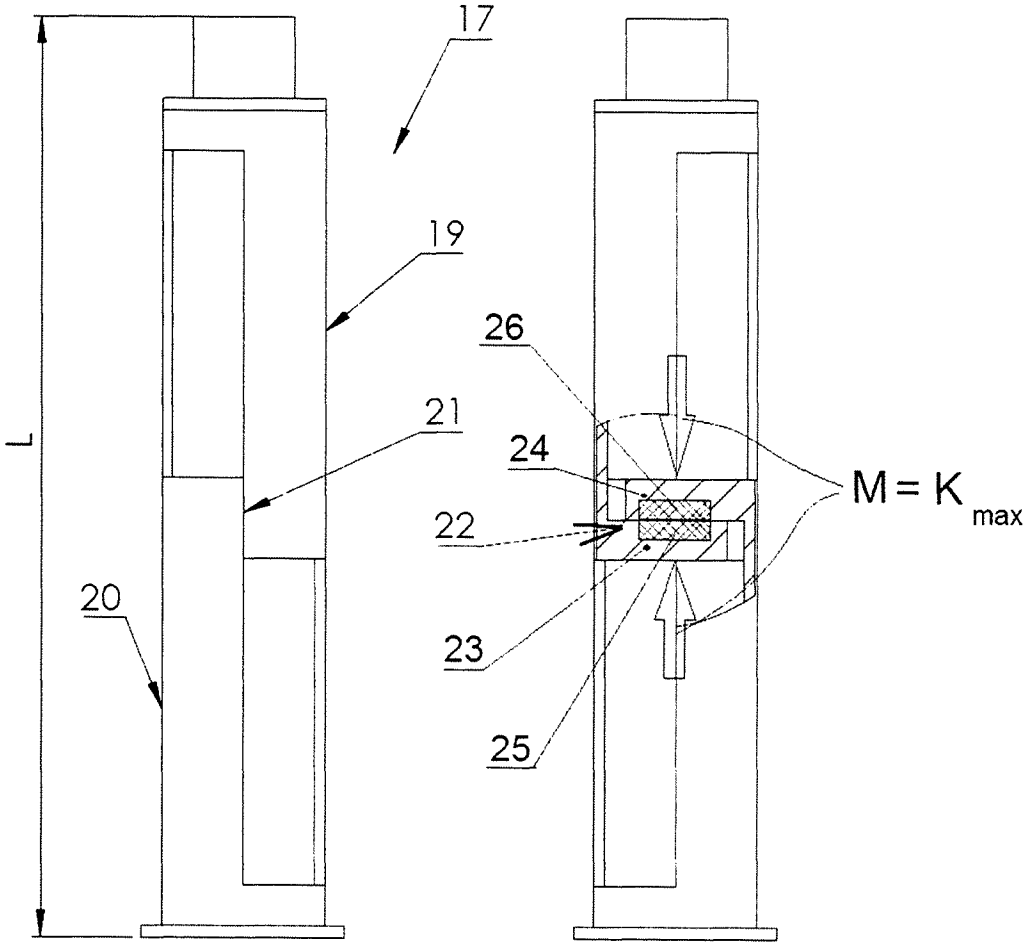
Figure 3B:
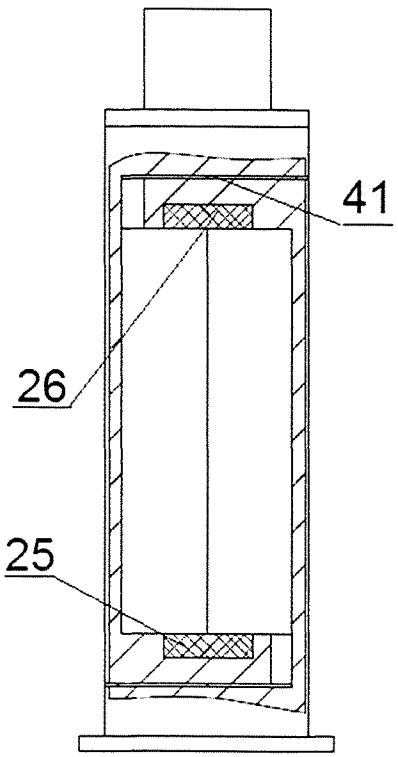
Figure 3A:
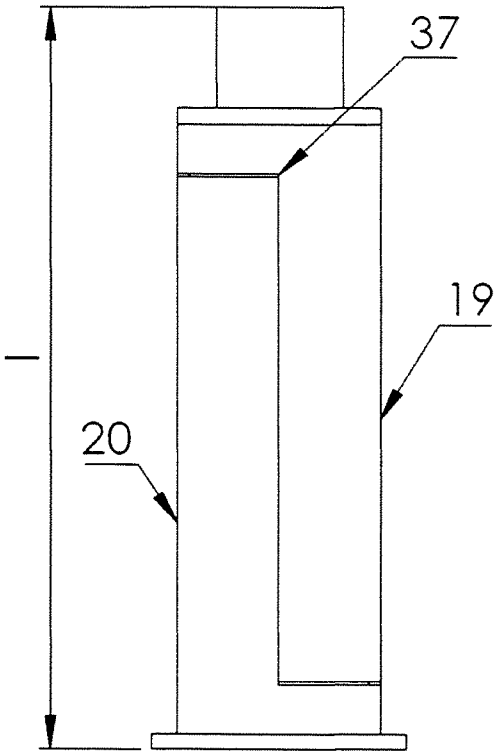
Figure 4C:
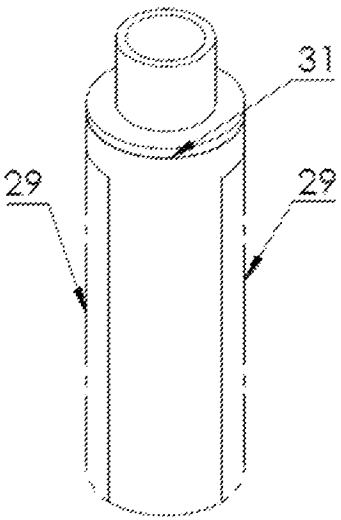
Figure 4B:
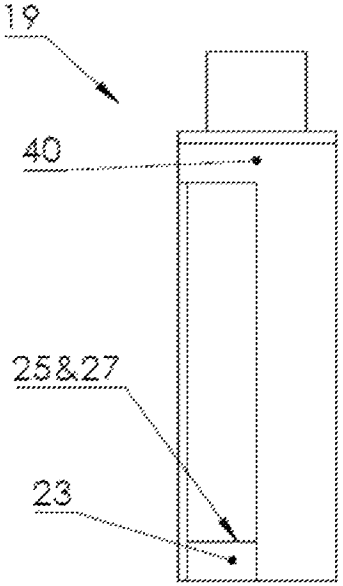
Figure 4A:
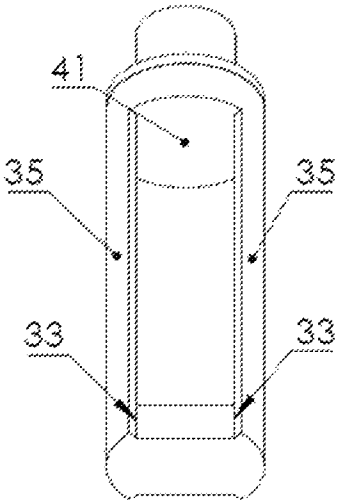

Further features and advantages of the invention will become apparent from the following description and the drawing, wherein a preferred embodiment of the invention is illustrated and explained in more detail by means of an example. It shows:

FIG. 1 a device applied to the thorax of a patient for cardiopulmonary massage according to the invention in a perspective view obliquely from above;

FIG. 2*a,b* a preferred embodiment of the massage stamp used in the device according to FIG. 1 in a first position, in two different side views, partially in section;

FIG. 3*a,b* the object of FIG. 2 in a second position, which is shortened with respect to the first position;

FIG. 4*a-c* the stamp upper part of the massage stamp according to FIGS. 2 and 3, in three different presentations; and FIG. 5 the stamp upper part of the massage stamp according to FIGS. 2 and 3, also in three different presentations.

In FIG. 1 is shown, designated in its entirety with 10, a device for cardiopulmonary massage and/or resuscitation of a patient 11 in its position applied to his thorax 12. The device 10 has an abutment board 14 placed under the back 13 of the patient 11, in the one corner region of which there being arranged an upwardly projecting portal support 15. The portal support 15 is pivotable relative to the abutment board 14 about a vertical axis and is arranged displaceable in height. It can—preferably continuously—be locked at different height positions. At its upper end, it carries a cantilever arm 16 which is also articulated to the portal support 15 about a vertical axis. The cantilever arm 16, in turn, is provided at its outer, free end with a massage stamp 17 which is reversibly driven up and down in a substantially vertical actuating direction 18 by means of a drive apparatus arranged in the interior of the cantilever arm housing. The massage stamp 17, which compresses the thorax of the patient during its downward movement and thereby exerts a compression force K and relieves the thorax again with the upward movement, is shown in more detail in FIGS. 2 to 5.

The massage stamp 17 has a stamp upper part 19 and a stamp lower part 20, which is operatively connected to the stamp upper part 19. The two stamp parts 19 and 20 are aligned coaxially with one another and guided telescopically into one another so that they can be adjusted in the actuation direction 18 relative to one another at least between a first position defining a working length L and a second position in which an effective length l of the massage stamp 17 is shortened compared to the working length L. In the first position, in which the massage stamp 17 has the (greater) working length L, the stamp upper part 19 and the stamp lower part 20 are locked together with a locking mechanism 21. Upon reaching a predetermined maximum allowable compression force $K_{max}$, which is exerted by the massage stamp on the thorax of the patient, the locking mechanism 21 releases and thus cancels the operative connection of the two stamp parts 19, 20 in the first position. The arrangement is such that when the locking mechanism is released, the stamp lower part 20 and the stamp upper part 19 push together, so that the massage stamp 17 at the end of this process only has the shortened length l corresponding to the second position. This pushing together can be supported by an actuating element effective between the stamp upper part and the stamp lower part, e.g. a biased tension spring (not shown) engaging at the bottom of the stamp lower part and at the top at the stamp upper part, which actively draws or pushes the two stamp parts together into the short effective length l as soon as the locking mechanism has released.

In the exemplary embodiment, the locking mechanism 21 is substantially formed by a magnetic holding device 22 effective between the stamp upper part 19 and the stamp lower part 20, the magnetic holding force M of which corresponds to the predetermined compression force $K_{max}$. The arrangement is made in the present case so that the stamp upper part 19 has an upper part bottom 23 and the stamp lower part 20 has a bottom part cover 24. This is located in the massage stamp 17 above the upper part bottom 23. The magnetic holding device 22 has two holding magnets 25, 26, one of which is embedded on the upper side 27 of the upper part bottom 23 and the other coaxial therewith on the lower side 28 of the lower part cover 24 so that they attract each other. The locking mechanism 21 in the form of the magnetic holding device 22 thus engages between the upper part bottom 23 and the lower part cover 24 and firmly pulls the two stamp parts 19, 20 with the magnetic holding force M effective between the holding magnets 25, 26 in the first position, that is, the extended working length L, against each other. In the drawing (FIGS. 4 and 5) it can easily be seen that the stamp upper part 19 and the stamp lower part 20 are provided with mutually complementary recesses 29, 30 in their circumferential walls 31, 32, which extend essentially over the entire height of the stamp parts 19, 20. These recesses 29, 30 form, on the one hand, a passage for radially external holding portions 33 of the upper part bottom 23 in the stamp lower part 20 and, on the other hand, for corresponding holding portions 34 of the lower part cover 24 in the stamp upper part 19. In this way, the two stamp parts 19, 20 can displace into each other in the direction 18 when, during a cardiac massage, the maximum compression force corresponding to the magnetic holding force in the first working position is reached and then releases the locking mechanism. The stamp lower part 20, which is provided at the bottom with a pressure surface D, with which it rests on the thorax 12 of the patient (FIG. 1) loses, when releasing the locking mechanism 21, its fixed connection with the upper stamp part 19 effected by the holding magnets, and pushes, without further exerting any appreciable force on the thorax 12 of the patient, into the upper stamp part 19 when this is moved further down by the drive apparatus. The wall webs 35 of the stamp upper part 19, which are located between the two recesses 29, thereby push into the recesses 30 in the stamp lower part 19, while the wall webs 36 of the stamp lower part 20 slide fittingly into the corresponding recesses 29 on the stamp upper part 19, until the two stamp parts 19, 20 are pushed together into the second, shortened position with the shorter length l. The massage stamp 17 can then no longer exert a compression force on the patient thorax 12, the cardiac massage is thus automatically interrupted as soon as the compression force that has to be transmitted by the magnetic holding device in the exemplary embodiment is reached or exceeded.

In order to hold the two stamp parts in the second position to each other after releasing the locking mechanism 21 and then retracting the stamp lower part 20 relative to the stamp upper part 19, a securing mechanism 37 effective between the stamp upper part 19 and the stamp lower part 20 is provided. In the exemplary embodiment, the securing mechanism 37 is essentially formed by the holding magnet 26 arranged in the lower part cover 24, which also still generates a sufficiently large magnetic holding force on the upper side 38 of the lower part cover in cooperation with a counter surface 41 formed on the upper end 40 of the stamp upper part 19, in order to hold the stamp lower part in the shortened length l of the massage stamp when the stamp lower part 20 retracts and abuts its lower part cover 24 at the upper end 40 of the stamp upper part 19. The holding force exerted by the holding magnet 26 on the ferromagnetic counter surface 41 then ensures that the two stamp parts 19, 20 do not move apart again themselves when the stamp upper part 19 of the massage stamp 17 is lifted again by the drive apparatus during the decompression stroke. Rather, the stamp lower part 20 then takes part of this upward movement of the stamp upper part 19, since it is sufficiently firmly connected to the stamp upper part 19 by the holding magnet 39 engaging the counter surface 41.

With the invention it is ensured that the cardiac massage is interrupted immediately upon reaching the predetermined compression force, because this causes the locking mechanism to be released and the two stamp parts are brought into the second position with a shortened effective length l. It is possible to detect the release of the locking mechanism and/or pushing together of the stamp parts by means of a sensor, which then stops the drive apparatus for the massage stamp 17, expediently when it has again reached its highest position prior to the start of a subsequent compression stroke (movement downwards).

The invention is not limited to the illustrated and described embodiment, but various changes and additions are conceivable without departing from the scope of the invention. For example, it is conceivable that at least one of the holding magnets of the magnetic holding device 22 is exchangeable and can be exchanged with a magnet with a larger or smaller holding force. In this way, the compression force at which the locking mechanism is released can be adjusted. This goal can also be achieved by making the distance between the two holding magnets in the first position of the stamp parts mutually variable, e.g. with the help of an adjustable depth stop. The greater the distance between the two holding magnets is selected, the lower is then the holding force acting between them.

Instead of the magnetic holding device, a preferably spring-loaded snap connection can be used as locking mechanism, e.g. a ring snap connection or a hook-snap connection. The securing mechanism can also be designed in a similar manner, which holds the two stamp parts to each other in the second position with a shortened length of the massage stamp.

The pressure surface, which is formed at the stamp lower part, can be designed in an exchangeable manner, so that pressure surfaces of different shape and size, if necessary, can also be used with different soft/hard coatings.

LIST OF REFERENCE NUMERALS

10 Device
11 Patient
12 Thorax
13 Back
14 Abutment board
15 Portal support
16 Cantilever arm
17 Massage stamp
18 Actuation direction
19 Stamp upper part
20 Stamp lower part
21 Locking mechanism
22 Magnetic holding device
23 Upper part bottom
24 Lower part cover

25 first holding magnet
26 second holding magnet
27 Upper side of 23
28 Lower side of 24
29 Recesses in 19
30 Recesses in 20
31 Circumferential walls of 19
32 Circumferential walls of 20
33 Holding portions at 23
34 Holding portions at 24
35 Wall webs of 19
36 Wall webs of 20
37 Securing mechanism
38 Upper side of 24
39 Securing holding magnet
40 upper end of 19
41 Counter surface
L Length of 17 in the first position (long)
L Length of 17 in the second position (short)
K Compression force
M Magnetic holding force
D Pressure surface

The invention claimed is:

1. A device for cardiopulmonary massage and/or resuscitation, comprising a massage stamp that can be reversibly driven by a drive apparatus in an actuation direction, which massage stamp has a pressure surface that can be positioned on the thorax of a patient, wherein:

the massage stamp has a stamp upper part and a stamp lower part operatively connected to the stamp upper part;

the stamp upper part and the stamp lower part are adjustable in the actuating direction relative to each other at least between a first position defining a working length and a second position in which an effective length of the massage stamp is shortened compared to the working length;

in the first position, the stamp upper part is locked to the stamp lower part via a releasable locking mechanism; and the locking mechanism releases upon reaching/exceeding a predetermined compression force transmitted from the massage stamp, wherein the locking mechanism is substantially formed by a magnetic holding device effective between the stamp upper part and the stamp lower part, whose magnetic holding force corresponds to the predetermined compression force.

2. The device according to claim 1, wherein the stamp upper part and the stamp lower part are aligned coaxially with each other and are guided telescopically into each another.

3. The device according to claim 2, wherein the stamp upper part and the stamp lower part each comprise circumferential walls, said circumferential walls being provided with complementary recesses for the passage of an upper part bottom in the stamp lower part and a lower part cover in the stamp upper part, wherein said recesses extend over substantially the entire height of said circumferential walls of said stamp upper part and said stamp lower part.

4. The device according to claim 3, wherein the stamp upper part and the stamp lower part each have at least two recesses.

5. The device according to claim 1, wherein the stamp upper part has an upper part bottom and the stamp lower part has a lower part cover, which is located in the massage stamp above the upper part bottom, and that the locking mechanism engages between the upper part bottom and the lower part cover.

6. The device according to claim 5, wherein the locking mechanism comprises at least one holding magnet arranged on the upper part bottom and/or on the lower part cover or formed thereby.

7. The device according to claim 1, wherein the magnetic holding device has at least one exchangeable holding magnet.

8. The device according to claim 1, further comprising a connection adapter arranged on the stamp upper part at its upper end for quick connection to the drive apparatus.

9. The device according to claim 1, further comprising the pressure surface at the lower end of the stamp lower part is arranged in an exchangeable manner.

10. The device according to claim 1, further comprising a securing mechanism effective between the stamp upper part and the stamp lower part, after releasing the locking mechanism and adjusting the stamp lower part relative to the stamp upper part, holding their position in the second position to each other.

11. The device according to claim 10, wherein the securing mechanism is essentially formed by a securing holding magnet.

12. The device according to claim 11, wherein the securing mechanism is essentially formed by a spring-loaded snap-hook connection.

13. The device according to claim 10, wherein the securing holding magnet is effective between the upper side of the lower part cover and a counter surface formed on the upper end of the stamp upper part or on the drive apparatus.

14. A device for cardiopulmonary massage and/or resuscitation, comprising a massage stamp that can be reversibly driven by a drive apparatus in an actuation direction, which massage stamp has a pressure surface that can be positioned on the thorax of a patient, wherein: the massage stamp has a stamp upper part and a stamp lower part operatively connected to the stamp upper part; the stamp upper part and the stamp lower part are adjustable in the actuating direction relative to each other at least between a first position defining a working length and a second position in which an effective length of the massage stamp is shortened compared to the working length; in the first position, the stamp upper part is locked to the stamp lower part via a releasable locking mechanism; and the locking mechanism releases upon reaching/exceeding a predetermined compression force transmitted from the massage stamp, wherein the stamp upper part has an upper part bottom and the stamp lower part has a lower part cover, which is located in the massage stamp above the upper part bottom, and that the locking mechanism engages between the top surface of upper part bottom and bottom surface of the lower part cover.

15. The device according to claim 14, wherein the locking mechanism comprises at least one holding magnet arranged on the upper part bottom and/or on the lower part cover or formed thereby.

* * * * *